US010317031B2

(12) United States Patent
Tatara et al.

(10) Patent No.: US 10,317,031 B2
(45) Date of Patent: Jun. 11, 2019

(54) VEHICLE LAMP

(71) Applicant: KOITO MANUFACTURING CO., LTD., Tokyo (JP)

(72) Inventors: Naoki Tatara, Shizuoka (JP); Satoshi Yamamura, Shizuoka (JP); Naoki Uchida, Shizuoka (JP); Toshiaki Tsuda, Shizuoka (JP)

(73) Assignee: KOITO MANUFACTURING CO., LTD., Tokyo (JP)

( * ) Notice: Subject to any disclaimer, the term of this patent is extended or adjusted under 35 U.S.C. 154(b) by 490 days.

(21) Appl. No.: 15/130,677

(22) Filed: Apr. 15, 2016

(65) Prior Publication Data

US 2016/0305626 A1 Oct. 20, 2016

(30) Foreign Application Priority Data

Apr. 15, 2015 (JP) ..... 2015-083374

(51) Int. Cl.

| | |
|---|---|
| ***F21S 41/14*** | (2018.01) |
| ***F21S 41/16*** | (2018.01) |
| ***F21S 41/20*** | (2018.01) |
| ***F21S 41/32*** | (2018.01) |
| ***F21S 45/00*** | (2018.01) |

(52) U.S. Cl.

CPC ..... *F21S 41/285* (2018.01); *F21S 41/14* (2018.01); *F21S 41/16* (2018.01); *F21S 41/32* (2018.01); *F21S 45/00* (2018.01)

(58) Field of Classification Search

CPC ..... F21S 41/14; F21S 41/16; F21S 41/285; F21S 41/32; F21S 45/00

See application file for complete search history.

(56) References Cited

U.S. PATENT DOCUMENTS 6,883,947 B1 * 4/2005 Sarabia ..... B60Q 1/28 362/540
8,791,628 B2 7/2014 Fukai et al.
9,970,619 B2 * 5/2018 Nomura ..... H01S 5/005
(Continued)

FOREIGN PATENT DOCUMENTS

DE 102013016423 A1 4/2015
EP 2781408 A2 9/2014
(Continued)

OTHER PUBLICATIONS

Machine Translation of WO 2014/072226 (Year: 2014).*
(Continued)

*Primary Examiner* — Robert J May
*Assistant Examiner* — Leah Simone Macchiarolo
(74) *Attorney, Agent, or Firm* — Osha Liang LLP

(57) ABSTRACT

A vehicle lamp includes a semiconductor laser element configured to emit laser light, a condenser lens configured to condense the laser light, a phosphor configured to form white light by converting wavelength of at least a portion of the laser light condensed, and a reflector configured to reflect the white light. A light transmitting portion is formed in a portion, at which an extension path obtaining by extending an optical path of the laser light before contacting the phosphor is intersected with the reflector, of the reflector. A light confinement part is formed above the light transmitting portion.

6 Claims, 7 Drawing Sheets

(56) References Cited

U.S. PATENT DOCUMENTS

2006/0126353 A1* 6/2006 Ishida ..... F21V 7/0091 362/543
2007/0183167 A1* 8/2007 Koike ..... F21V 7/22 362/514
2008/0316757 A1* 12/2008 Sato ..... F21V 29/505 362/487
2011/0063115 A1* 3/2011 Kishimoto ..... F21K 9/00 340/600
2012/0104934 A1 5/2012 Fukai et al.
2012/0140501 A1* 6/2012 Nakazato ..... F21S 41/16 362/510
2014/0168940 A1* 6/2014 Shiomi ..... B60Q 1/0023 362/84
2014/0204398 A1 7/2014 Sato et al.
2014/0268846 A1* 9/2014 Nakazato ..... F21S 48/1145 362/510
2016/0003707 A1* 1/2016 Ahn ..... G01J 3/505 356/402
2016/0033112 A1* 2/2016 Weissenberger ..... F21V 25/02 362/510
2016/0178155 A1* 6/2016 Owada ..... B60Q 1/08 362/465
2017/0191636 A1* 7/2017 Khrushchev ..... F21V 9/14
2017/0240094 A1* 8/2017 Kunecke ..... F21V 25/02
2017/0314754 A1 11/2017 Schragl et al.
2018/0073697 A1* 3/2018 Brandel ..... F21V 29/51

FOREIGN PATENT DOCUMENTS

EP 3138732 A1 3/2017
JP 2013-101887 A 5/2013
JP 2013-191479 A 9/2013
JP 2014-022084 A 2/2014
JP 2014-180886 A 9/2014
JP 2014-212067 A 11/2014
WO 2014/072226 A1 5/2014
WO 2015/049048 A1 4/2015
WO 2016/070968 A1 5/2016
WO 2016/081967 A1 6/2016

OTHER PUBLICATIONS

Office Action issued in corresponding Chinese Application No. 201610237000.2, dated Dec. 29, 2017 (14 pages).
Notification of Reasons for Refusal issued in Japanese Application No. 2015-083374, dated Nov. 27, 2018 (15 pages).
Preliminary Search Report issued in French Application No. 1653329, dated Oct. 18, 2018 (8 pages).

* cited by examiner

VEHICLE LAMP

CROSS-REFERENCE TO RELATED APPLICATION

The present application claims priority from Japanese Patent Application No. 2015-083374 filed on Apr. 15, 2015, the entire content of which is incorporated herein by reference.

BACKGROUND

Technical Field

The present invention relates to a vehicle lamp having a semiconductor laser element as a light source and, more particularly, to a vehicle lamp for generating a white light by combining a semiconductor laser element and a phosphor.

In a vehicle lamp such as an automobile headlamp, it has been attempted to use a laser diode (LD) in place of a light emitting diode (LED) (see Patent Document 1). Since an LD light source has a high light-conversion efficiency and a small light-emitting area, the LD light source is advantageous for miniaturization of the lamp. In the vehicle lamp using the LD light source, a laser light, e.g., a blue laser light is irradiated from an LD element to a phosphor that is a wavelength-conversion element, a light, e.g., a yellow light is emitted due to excitation of the phosphor, and the blue laser light and the yellow light are mixed, thereby emitting a white light.

Laser light is a high-energy light having strong directivity. When being used as a light of a vehicle headlamp or the like, as described above, the laser light contacts the phosphor and is scattered. In this way, the laser light is converted into a white light which is suitable for road surface irradiation and has a suitable energy. When the laser light is not contacted with the phosphor sufficiently but is reflected in the reflector while maintaining a high-energy, the high-energy laser light is irradiated to a pedestrian, a vehicle or a road surface or the like in front of a vehicle. In order to avoid such a situation, the phosphor is strongly fixed to a mounting body in order to prevent the detachment or damage thereof.

In order to avoid the direct irradiation of high-energy laser light, that is, in order to confirm that the laser light contacts the phosphor and is properly scattered, a light detector is typically installed at a required place of an optical path to measure an amount of energy (intensity of light) or wavelength of light, thereby checking the presence or absence of abnormality. When abnormality is detected and it is determined that high-energy laser light is radiated without contacting with the phosphor, the phosphor is estimated to be detached or damaged for some reason, thereby stopping the driving of the laser element.

In addition to this, there has been suggested that high-energy laser light is prevented from being reflected to the front from a reflector by forming a through hole penetrating the reflector or an escape hole (reference numeral H2 in Patent Document 1) in the reflector contacted by the laser light and thereby allowing the laser light to be escaped to the outside of the reflector in an abnormal situation.

Patent Document 1: Japanese Patent Laid-Open Publication No. 2014-180886

When the escape hole is formed in the reflector described above, the laser light is not reflected in the reflector but is guided into the space of the lamp chamber on the outside of the reflector even when the phosphor is detached or damaged and the high-energy laser light reaches the reflector. In this way, typically, the laser light is not reflected to the front.

However, a large number of parts are disposed in the lamp chamber of the vehicle and most of the parts reflect the light. Therefore, the laser light, which is guided to the back side of the reflector through the escape hole, is repeatedly reflected multiple times. Consequently, there is a possibility that the high-energy laser light is irradiated toward the front.

SUMMARY

Exemplary embodiments of the invention provide a vehicle lamp which is capable of suppressing the laser light from being reflected in the reflector and being directly irradiated to the front even when a phosphor is detached from a predetermined position or even when the phosphor is damaged, and hence, cannot fulfill a normal function.

A vehicle lamp according to an exemplary embodiment comprises:

a semiconductor laser element configured to emit laser light;

a condenser lens configured to condense the laser light;

a phosphor configured to form white light by converting wavelength of at least a portion of the laser light condensed; and a reflector configured to reflect the white light, wherein a light transmitting portion is formed in a portion, at which an extension path obtaining by extending an optical path of the laser light before contacting the phosphor is intersected with the reflector, of the reflector, and, wherein a light confinement part is formed above the light transmitting portion (Operation)

In such a configuration, in a normal situation, i.e., while the phosphor fixed in a predetermined position converts the wavelength of at least a portion of the laser light, strong directivity of high-energy laser light is weakened to generate a low-energy white light, and the white light contacts with the reflector over a relatively wide area. Therefore, nearly all of the white light is reflected to the front to irradiate a road surface or the like. The rest of the white light reaches the light transmitting portion on the surface of the reflector and is guided into the light confinement portion. Most of the light passing through the light transmitting portion is confined in the light confinement portion and is not irradiated to the front.

However, in the configuration that the light transmitting portion is not formed in the surface of the reflector, when the phosphor is detached from a predetermined position or the phosphor is functionally deteriorated even at the time of being present in the predetermined position, high-energy laser light is directly reflected, or laser light that is not sufficiently converted into lower-energy light is concentrated on a very narrow range of the reflector and then is directly reflected. Therefore, the high-energy laser light is irradiated to a road surface or a pedestrian or the like. Further, even when the escape hole is formed, there is a possibility that the laser light passing through the escape hole is reflected multiple times for each member inside the lamp chamber, and hence, is indirectly irradiated to the front from the lamp chamber.

On the contrary, the present invention is configured as follows. Specifically, there is a case that the phosphor is detached or is functionally deteriorated, and hence, laser light (e.g., blue or purple short-wavelength laser light) to be converted into a low-energy light by contacting with the phosphor approaches a very narrow range of the reflector while maintaining high energy. Even in this case, since the light transmitting portion is formed in the surface of the reflector corresponding to the extension path of the optical path of laser light, there is no case that the laser light is directly reflected from the reflector and irradiated to the front. Furthermore, since the light confinement portion is formed above the light transmitting portion, all or almost all of the laser light passing through the light transmitting portion is not irradiated to the front through the light transmitting portion.

As described above, in the normal situation, all or almost all of the white light, which is guided into the light confinement portion, is confined in the light confinement portion and is not irradiated to the front, so that the loss of the white light occurs. However, the laser light is characterized by strong directivity and the area of the reflector where the laser light without contacting the phosphor reaches is very narrow, and hence, the area of the light transmitting portion is also very narrow. Therefore, the loss of the white light is very small.

The light transmitting portion may be an escape hole and the light confinement part may be a closed space formed above the escape hole. At least a portion of a wall surface forming the closed space is configured to generate a scattered light by reflecting (irregularly reflecting) a part of the light which reaches the light confinement part. The vehicle lamp may further comprise at least one photo sensor configured to detect the scattered light.

(Operation)

In the present configuration, the laser light, which is not contacted or insufficiently contacted with the phosphor in the abnormal situation, reaches the escape hole and is guided into a closed space through the escape hole. Then, the laser light is irregularly reflected in a light scattering surface inside the closed space and is diffused as a scattered light. In the scattered light, directivity of the laser light is eliminated or weakened, and hence, energy level is low. Therefore, even when the scattered light is leaked from the closed space, the high-energy light is not irradiated to the front of the vehicle.

When abnormality occurs in the phosphor and the laser light is thus irradiated to the downstream side of the phosphor, it is desirable to turn off a light source. Since the laser light reaches the closed space in the abnormal situation, the laser light may be directly detected by using the photo sensor. In this case, it is required to install the photo sensor in the optical path of the laser light. However, since the laser light has strong directivity and a sectional area of the optical path is small, the photo sensor may not be accurately installed in the optical path of the laser light. Furthermore, in the abnormal situation, in addition to the detachment or damage of the phosphor, the light source of the laser light is also displaced by a force applied thereto. Accordingly, there is a possibility that the optical path of the laser light is changed.

In order to avoid such a situation, according to the present aspect, the entire inner surface of the wall surface to configure the closed space or the inner surface contacting the optical path of the laser light and its surroundings are set as a light scattering surface. The laser light contacting the light scattering surface is irregularly reflected and is thus diffused, as a low-energy scattered light where directivity is eliminated or weakened, substantially in all directions of the closed space. The scattered light is diffused not only in the closed space but also in a portion of the lamp chamber inside the reflector through the escape hole. The scattered light has a wavelength or energy level different from the laser light or the white light generated in the normal situation. Therefore, when a photo sensor capable of detecting the wavelength or energy level other than that of the white light is installed in the closed space or the lamp chamber where the scattered light reaches, the photo sensor is not operated in the normal situation but can detect the laser light or the scattered light generated in the abnormal situation. Based on this detection, the light source of the laser light can be immediately turned off.

A single photo sensor may be installed in the optical path of the laser light or in the closed space or the lamp chamber where the scattered light reaches. However, in the abnormal situation, in addition to the detachment or damage of the phosphor, the photo sensor may be detached or damaged. Therefore, it is desirable that a plurality of photo sensors is installed so as to reliably detect abnormality of the laser light.

The light transmitting portion may be an escape hole and the light confinement part may be a closed space formed above the escape hole. The vehicle lamp may further comprise a light-shielding metal configured to reduce a leakage amount of light, the light-shielding metal provided on the extension path of the optical path of the laser light in the closed space.

(Operation)

In the present configuration, the laser light, which is not contacted or insufficiently contacted with the phosphor in the abnormal situation and reaches a closed space through the escape hole, comes into contact with the light-shielding metal. Thereby, at least a portion of the laser light is shielded and the amount of the laser light is thus reduced. In this way, even when the laser light is indirectly irradiated to the front of the vehicle, the leakage amount of the laser light can be significantly reduced.

Typically, the light-shielding metal has a plate-like shape capable of sufficiently blocking the optical path of the laser light. Material of the light-shielding metal can include various metals such as iron, nickel, aluminum or copper and metal alloy such as stainless steel. In order to sufficiently increase light-shielding property, the surface of the light-shielding metal may be painted by black.

The reflector may have a transparent resin base body, and a reflective surface of the reflector is formed by a deposition layer which is coated and formed on a part of an inner surface of the reflector. A surface, which is surrounded by the deposition layer and on which the deposition layer is not formed, may serve as the light transmitting portion, and the transparent resin base body serves as the light confinement part.

(Operation)

In the present configuration, when coating a deposition layer on an inner surface of the transparent resin to form a reflective surface thereon, the portion of the transparent resin, which is not coated by the deposition layer, is formed as a masking portion. The making portion is slightly greater than the portion which corresponds to an optical path (divergence range of the laser light) of the laser light in the abnormal situation. The masking portion is configured in such a way that the laser light which is not wavelength-converted in the abnormal situation is guided into the transparent resin through the making portion, and then, is transmitted through the transparent resin. In this way, the high-energy laser light can be prevented from being reflected in the deposition layer on the surface of the transparent resin and being irradiated to the front of the vehicle.

When the laser light is irradiated to the transparent resin, the surface of the transparent resin may be modified and become opaque. However, in the present configuration, even when the masking portion of the transparent resin becomes opaque by being irradiated by the laser light, and thus, the laser light is entirely or partially blocked, hindrance for the purpose of avoiding the front reflection of the laser light does not occur. Rather, the effect is more reliably achieved.

The present configuration where the front reflection of the laser light is avoided by forming the masking portion is simpler than the configuration where the front reflection of the laser light is avoided by forming the escape hole on the reflector. As an available transparent resin, an acrylic resin, polycarbonate resin and silicone resin can be used.

The vehicle lamp may further comprise:

a photo sensor provided on the extension path of the optical path of the laser light in the transparent resin base body.

(Operation)

Even if the low-energy of the laser light can be achieved by using the inventions described above, it is undesirable to leave the vehicle lamp where the phosphor is detached or damaged. In the present configuration, the wavelength or energy level of the laser light is detected by the photo sensor installed on an optical path of the laser light in the transparent resin base body, thereby recognizing abnormality of the phosphor. Further, by informing the abnormality to a driver by using an alarm or the like, it is possible to quickly deal with the abnormality.

In the present configuration, the transparent resin base body is used as the base body of the reflector. Therefore, the photo sensor can be fixed by being embedded into the transparent resin base body or being screwed to the outer surface of the transparent resin base body. On the contrary, in the related-art technique where the reflector having the escape hole formed therein is used, a base body for installing the photo sensor is required separately from the reflector. Therefore, it is difficult to install the photo sensor.

A light-shielding layer may be coated and formed on a surface opposite to the surface of the transparent resin base body where the deposition layer is formed.

(Operation)

When the light-shielding layer is not coated and formed on the transparent resin base body, there is a possibility that the laser light incident on the transparent resin base body is transmitted to the outside of the transparent resin base body from the outer surface of the transparent resin base body. Further, there is a possibility that the laser light transmitted is reflected by multiple members in the lamp and is finally irradiated to the front of the vehicle.

On the contrary, when, as in the present configuration, the light-shielding layer is formed on the outer surface of the transparent resin base body by a coating of a black paint or the like, the laser light incident on the transparent resin base body is not transmitted to the outside of the transparent resin base body from the outer surface of the transparent resin base body but is captured within the transparent resin base body. In this way, a possibility that the high-energy laser light is irradiated to the outside of the vehicle is eliminated or becomes very low.

The vehicle lamp may further comprise:

a shade provided between the phosphor and the light transmitting portion, the shade having a pin hole formed in such a way that a straight line connecting an expected maximum movement position of the condenser lens and an outer edge of the light transmitting portion passes through the inside of the pin hole.

(Operation)

In the vehicle lamp where the light transmitting portion is formed, when an emission direction of laser light by the laser element is a constant direction, typically, a vertical direction, the laser light is guided upward from the light transmitting portion, and hence, the high-energy laser light is not irradiated to the outside of the lamp chamber even if the phosphor is detached and the laser light reaches the vicinity of the reflector. This operation is the same as described above. However, when the laser element is inclined and thus the emission direction of the laser light is shifted from the vertical direction, a travelling direction of the laser light is also inclined. As a result, there is a possibility that the laser light reaches the surface of the reflector where the light transmitting portion is not present. This is similarly applied also in the case where the laser element is horizontally moved.

In this case, as in the present configuration, the pin hole is formed in such a way that a straight line connecting the expected maximum movement position of the condenser lens as a travelling base point of the laser light and an outer edge of the light transmitting portion passes through the inside of the pin hole. With this configuration, the laser light, which is emitted from the laser element and reaches the outside of the region of the light transmitting portion when the pin hole is not present and the laser element is inclined, is blocked by the shade having the pin hole, and thus, cannot reach the deposition layer around the light transmitting portion. As a result, the high-energy laser light is prevented from being reflected in the reflector and being irradiated to the front. The pin hole has a diameter greater than a width of the phosphor. Preferably, the diameter is set to about 1 mm.

Meanwhile, it is desirable to determine a positional relation between the pin hole and the light transmitting portion with high precision. Further, it is desirable that the shade having the pin hole and the reflector having the light transmitting portion formed therein are integrally molded.

In the vehicle lamp according to the present invention, the light transmitting portion is formed on the surface of the reflector and the light confinement portion is formed above the light transmitting portion. In this way, the laser light, which is not wavelength-converted and reaches the vicinity of the reflector in the abnormal situation, is directed to the light confinement portion and most of the laser light is confined in the light confinement portion. As a result, substantially all of high-energy laser light can be prevented from being irradiated to the front of the vehicle.

Furthermore, in one aspect of the present invention where the pin hole is formed, it is possible to prevent the front irradiation of the laser light due to the inclination or horizontal movement of the laser element.

DETAILED DESCRIPTION

Next, an embodiment of the present invention will be described.

Figure 1:
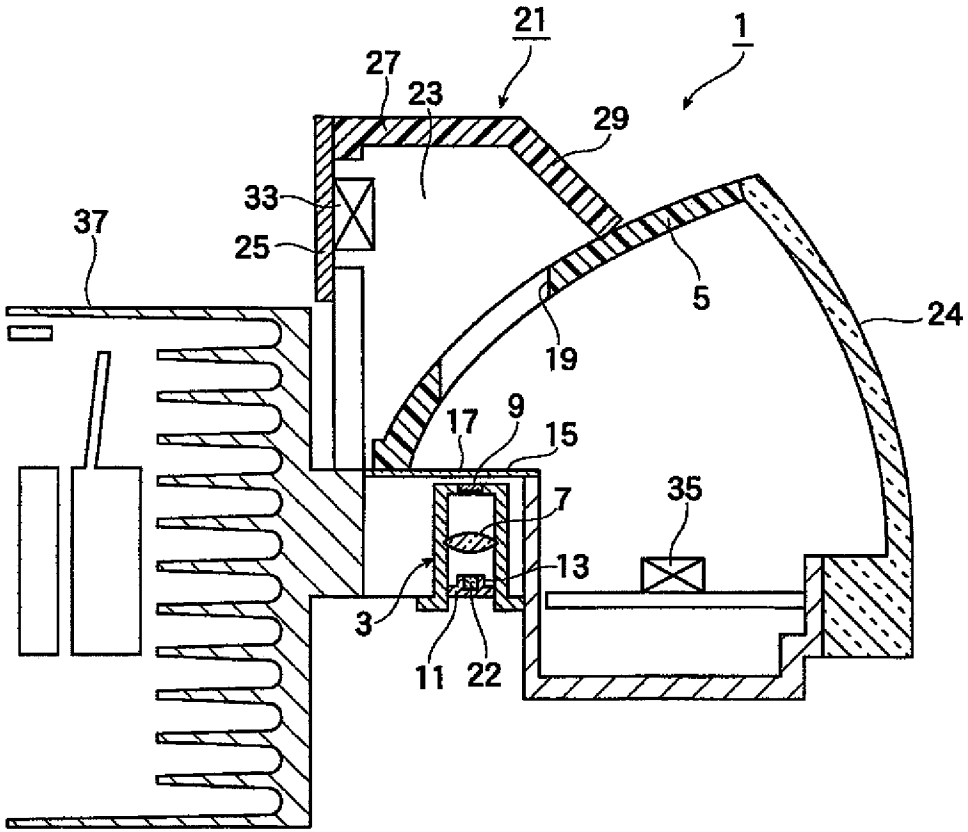
FIG. 1 is a longitudinal sectional view of a vehicle lamp according to a first embodiment of the present invention.
Figure 2:
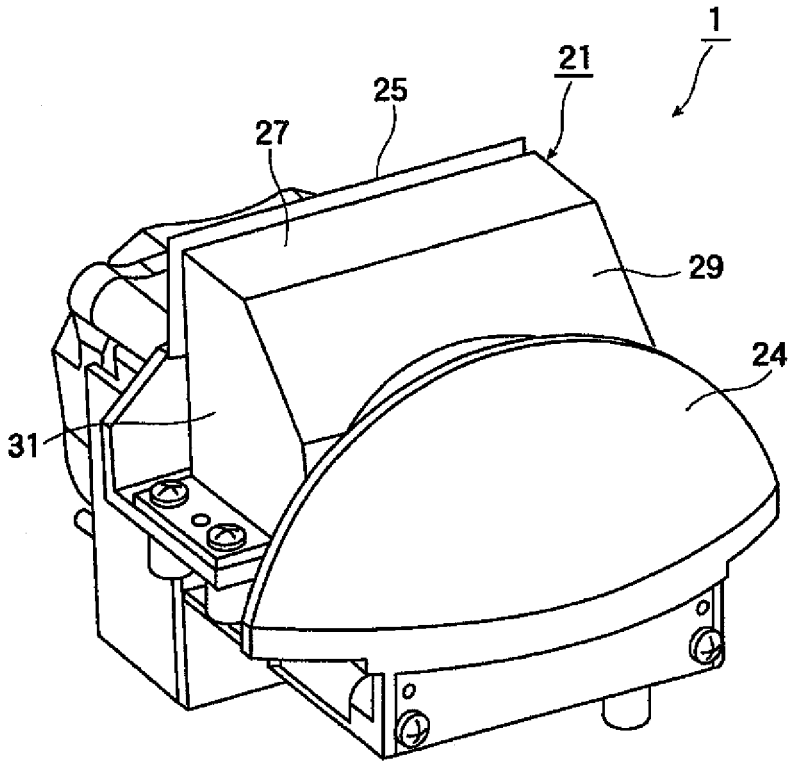
FIG. 2 is a perspective view of the vehicle lamp shown in FIG. 1.

As shown in FIGS. 1 and 2, a lamp unit 1 according to a first embodiment includes a cylindrical light emitting device 3, and a reflector 5 which has a dome shape to cover the range over the upper side from the side of the light emitting device 3. The light emitting device 3 includes a semiconductor laser element 22 for emitting laser light, a condenser lens 7 for condensing the laser light from the semiconductor laser element 22, and a phosphor 9. The light from the condenser lens 7 is irradiated to the phosphor 9 and is transmitted upward through the phosphor 9. The semiconductor laser element 22 is a semiconductor light emitting element for emitting laser light. For example, an element for emitting laser light of a blue emission wavelength (about 450 nm) or laser light of a near-ultraviolet emission wavelength (about 405 nm) is used.

The light emitting device 3 is formed in a cylindrical shape and is configured such that the semiconductor laser element 22 is fixed to the inside of an elliptical peripheral wall 13 integrally molded on a circular plate 11 located at a lower inner side. The condenser lens 7 is fixed to the approximate center of the cylindrical inner wall surface of the light emitting device 3. Further, a rectangular or circular fixing hole is formed at the center of the upper surface of the light emitting device 3. The phosphor 9 is bonded and fitted into the fixing hole by a transparent adhesive such as silicone or low-melting-point glass. Since a typical laser light is generated not in a perfect circle shape but in an elliptical shape, the fixing hole may be an elliptical hole. In either case, the fixing hole is shaped such that at least a portion of the laser light generated in the semiconductor laser element 22 is absorbed without being shielded, and is wavelength-converted and then transmitted.

For example, the phosphor 9 is a complex body of alumina ($Al_2O_3$) and YAG having activator such as cerium (Ce) introduced therein. The phosphor 9 has a plate-like shape or a layered shape including a lower surface and an upper surface, which are arranged substantially in parallel. A thickness of the phosphor 9 can be set to a proper thickness, depending on the desired chromaticity. The phosphor 9 emits white light which is generated by the color mixture of the wavelength-converted light described above and the laser light from the semiconductor laser element 22.

The condenser lens 7 condenses the laser light from the semiconductor laser element 22 and causes the condensed light to be irradiated to the phosphor 9. The condenser lens 7 is fixed to an inner wall between the phosphor 9 and the semiconductor laser element 22 in the cylindrical light emitting device 3.

A shade plate 15 is provided above the light emitting device 3. A pin hole 17 having a diameter less than 1 mm is formed in the shade plate 15. The pin hole 17 is formed in such a way that a straight line connecting an expected maximum movement position of the condenser lens 7 and an outer edge of a light transmitting portion (to be described later) passes through the inside of the pin hole. When an optical path of the laser light is changed due to inclination or movement of the light emitting device 3, the laser light is not incident, at a right angle, on the pin hole 17, and thus, cannot passes through the pin hole. Therefore, even when the phosphor 9 is detached or damaged, the high-energy laser light having strong directivity can be prevented from being reflected in the portion of the reflector 5 other than an escape hole as the light transmitting portion (to be described later) and being directly irradiated to the front of a vehicle.

Figure 3A:
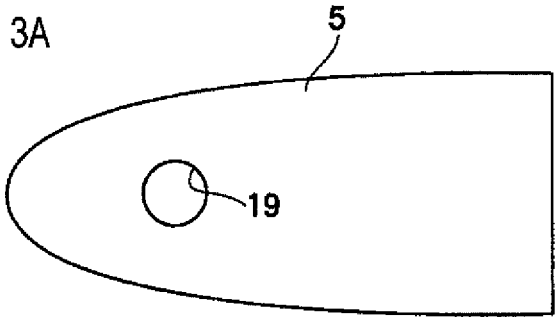
FIG. 3A is a bottom view of a reflector of the vehicle lamp shown in FIG. 1, and FIGS. 3B and 3C are bottom views showing modified examples of the reflector shown in FIG. 3A.
Figure 3B:
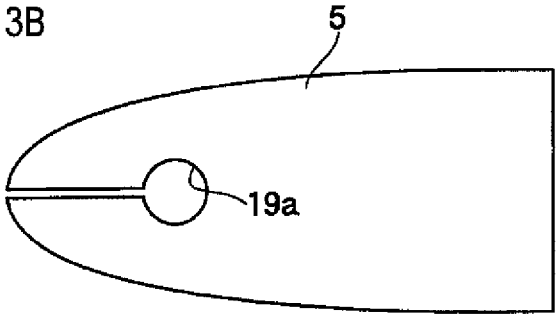
Figure 3C:
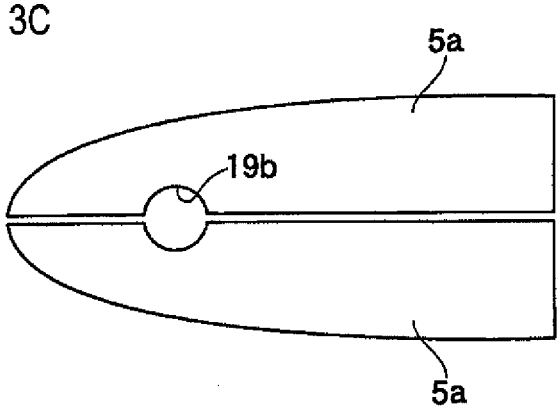

A rectangular escape hole (light transmitting portion) 19 is formed at the portion of the reflector 5 corresponding to the upper side of the light emitting device 3. An outer wall portion 21 is provided above the escape hole 19 so as to cover the escape hole 19. A space between the outer wall portion 21 and the reflector 5 is configured as a light confinement portion 23. A peripheral edge portion of a lower end of the light confinement portion 23 is bonded to an upper surface of the reflector 5. Further, an arcuate inner lens 24 is provided on the front end side of the reflector 5. The escape holes (19, 19*a*, 19*b*) may be, as shown in FIG. 3A, a circular hole 19 which is formed in the vicinity of the rear edge of the reflector 5, or, may have, as shown in FIG. 3B, a structure 19*a* where a circular hole is formed in the vicinity of the rear edge of the reflector 5 and a lateral groove directed to the rear edge is formed at the circular hole. Further, the escape hole may have, as shown in FIG. 3C, a structure where a reflector is split into two reflectors 5*a* in a front-rear direction, each reflector 5*a* is placed in a state of maintaining a fine gap therebetween, and a circular hole 19*b* corresponding to the circular holes 19, 19*a* shown in FIGS. 3A and 3B may be formed in both split reflectors 5*a*.

The outer wall portion 21 has a vertical wall portion 25, a horizontal wall portion 27 and an inclined wall portion 29. The vertical wall portion 25 extends in an up-down direction. The horizontal wall portion 27 is continuously provided to an upper end of the vertical wall portion 25 so as to extending in the forward direction. The inclined wall portion 29 is continuously provided to be inclined downward from a leading end of the horizontal wall portion 27. Respective wall portions 25, 27, 29 are integrated by a side wall 31. Further, a leading end of the downwardly inclined wall portion 29 is in contact with the reflector 5. At least a lower surface of the horizontal wall portion 27 is formed of a light absorbing material, for example, a black metal.

A first photo sensor 33 is accommodated at a front surface of the vertical wall portion 25 in the light confinement portion 23, and a second photo sensor 35 is accommodated in a space behind the inner lens 24. Further, a heat sink 37 is provided behind the light confinement portion 23. Heat generated in the light emitting device 3 is dissipated by the heat sink 37, so that overheating of the light emitting device 3 is suppressed.

Meanwhile, although not shown in the drawings, a projection lens is made of a transparent resin such as acrylic. For example, the projection lens is an aspherical lens having a front convex surface and a rear flat surface. The projection lens is fixed to a holder or the like and is disposed on an optical axis extending in a front-rear direction of a vehicle.

A related-art reflector has a dome shape to cover the range over the upper side from the side of the light emitting device. The dome-shaped reflector is formed such that substantially all of the white light generated in the phosphor of the light emitting device is reflected to the front, transmitted through the projection lens and then irradiated to the front of a vehicle. In this way, a basic light distribution pattern (e.g., at least a portion of a low-beam light distribution pattern) is formed on a virtual vertical screen (disposed at a position of about 25 m in front of a vehicle front surface) facing the vehicle front surface.

As described above, the reflector in the example shown is configured such that the escape hole 19 is formed at the location corresponding to the upper side of the light emitting device 3 and, out of light traveling in the order of the semiconductor laser element 22, the condenser lens 7 and the phosphor 9 and converted into the white light having weak directivity, light travelling almost directly upward enters the light confinement portion 23 through the escape hole 19. Scattered light which does not reach the escape hole 19 is reflected in the reflector 5 and is thus used to irradiate the front of the vehicle. Meanwhile, as will be described also in other embodiments described below, a percentage of the scattered light (which is the irregularly reflected light) included in the reflected light obtained by the lower surface of the reflector is slight. Most of the white light, which is generated in the phosphor 9 and is incident on the lower surface of the reflector in a normal situation, is typically reflected and is irradiated to the front of the vehicle.

Further, in the abnormal situation where the phosphor 9 is detached from a phosphor fixing hole or the function of the phosphor 9 is damaged, the laser light reaching the phosphor 9 is not wavelength-converted by the phosphor, and substantially all of laser light reaches the reflector 5 while maintaining strong directivity. In this case, when the escape hole is not formed as in the related-art reflector, the laser light having strong directivity is directly reflected in the lower surface of the reflector and is irradiated to the front of the vehicle.

However, in the present embodiment, as described above, the escape hole 19 is formed in the location of the lower surface of the reflector 5, to which the laser light travels. Therefore, substantially all of laser light, which is not wavelength-converted in the phosphor 9 in the abnormal situation but reaches the vicinity of the reflector 5, reaches the light confinement portion 23 through the escape hole 19 and is not irradiated to the front of the vehicle. Further, since a lower surface of the horizontal wall portion 27, which meets an optical path of the laser light directed to the inside of the light confinement portion 23, is formed of a light absorbing material, for example, a black metallic absorber, the laser light is completely or partially absorbed. Accordingly, even when the phosphor 9 is detached or damaged, the laser light can be prevented from being leaked to the outside of the vehicle.

In the present embodiment, as described above, the first photo sensor 33 and the second photo sensor 35 are provided in the light confinement portion 23 and behind the inner lens 24, respectively. In a normal situation where a white light is generated, a part of the white light reaching the light confinement portion 23 is absorbed by the light absorbing material. Further, since the white light is a scattered light, the scattered light, which is not absorbed in the light absorbing material, is further scattered by being reflected in the light confinement portion 23 or is scattered again outward from the light confinement portion 23, thereby reaching the first photo sensor 33 or the second photo sensor 35. In this way, by measuring the wavelength of the white light, it is possible to confirm that the white light is normally generated.

On the other hand, when the laser light directly reaches the light confinement portion 23 in the abnormal situation where the phosphor 9 is detached or damaged, most of the laser light contacts with the light absorbing material due to its strong directivity, and thus, all or a portion thereof is absorbed. Further, the laser light, which is not absorbed, is reflected at the surface of the light absorbing material. In this case, the white light does not reach the first photo sensor 33 or the second photo sensor 35, but slight laser light may reach the first photo sensor 33 or the second photo sensor 35. In either case, it is possible to detect the occurrence of abnormality by measuring the wavelength of the light reaching the photo sensor. In the present embodiment, the laser light having strong directivity is not substantially irradiated to the outside of the vehicle even when abnormality occurs in the phosphor. However, it is undesirable to leave the phosphor in the abnormal situation. Preferably, based on the detection of abnormality by the photo sensor, the vehicle is stopped in a safe place, and then, the lamp is turned off.

Further, as a countermeasure for preventing leakage of laser light in a low-speed driving in order to protect a pedestrian, a semiconductor laser element and a light emitting diode are prepared as a light source. The semiconductor laser element may be used in a high-speed driving, and the light emitting diode may be used in the low-speed driving.

Figure 4:
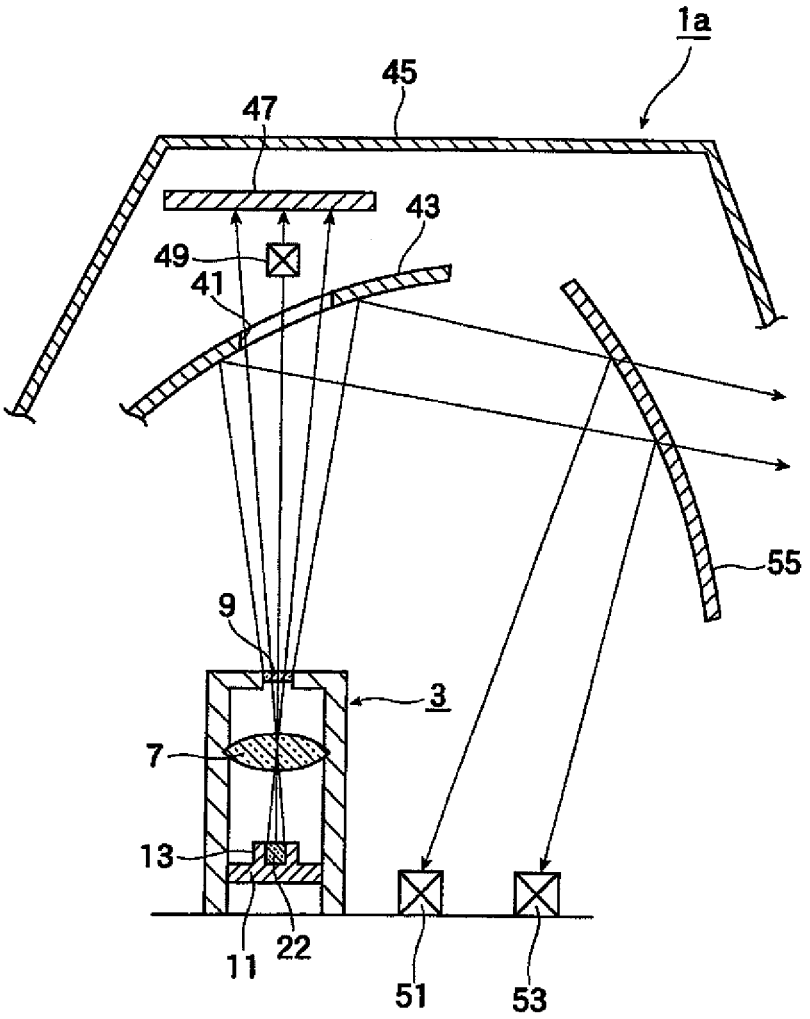
FIG. 4 is a longitudinal sectional view of a vehicle lamp according to a second embodiment of the present invention.

A light emitting device 3 of a lamp unit 1*a* of a second embodiment shown in FIG. 4 has substantially the same configuration as the light emitting device 3 of the first embodiment. Therefore, the same or similar parts are denoted by the same or similar reference numerals and a duplicated description thereof will be omitted. In the present embodiment, a specific example of an installation place of a photo sensor and a using aspect thereof will be described.

A reflector 43 having a rectangular escape hole (light transmitting portion) 41 formed therein is formed above the light emitting device 3. A light absorbing material plate (light confinement portion) 47 made of a black metal is provided between the reflector 43 and a lower surface of a top plate 45 of the lamp unit 1*a*. Material of the light absorbing material plate 47 can include various metals such as iron, nickel, aluminum or copper and metal alloy such as stainless steel. In order to sufficiently increase light absorbing property, the surface of the light absorbing material plate may be painted by black. A third photo sensor 49 is provided in an optical path of light between the escape hole 41 and the light absorbing material plate 47, and a fourth photo sensor 51 and a fifth photo sensor 53 are provided in the vicinity of the light emitting device 3. Further, a lens 55 for transmitting most of light and reflecting the other light is provided on the front side of the reflector 53.

In the present embodiment, in the normal situation, laser light generated in the semiconductor laser element 22 is converted into a white scattered light by being wavelength-converted in the phosphor 9 and travels in the direction of the escape hole 41. Small amounts of the scattered light enter the escape hole 41, so that a portion thereof passes through the third photo sensor 49 and is absorbed in the light absorbing material plate 47, and the most part thereof is reflected in the reflector 43 around the escape hole 41 and travels in the direction of the lens 55. Most of the white light reaching the lens 55 is transmitted through the lens 55 and irradiated to the front of the vehicle, and the remaining slight amount of the white light is reflected downwardly in the lens 55. In the example shown, two photo sensors 51, 53 are provided in the irradiation surface to which the reflected light is irradiated.

Since the third photo sensor 49 is provided in the optical path of the white light, the white light is securely detected. Further, also in the case of the two photo sensors 51, 53 (three or more photo sensors may be provided as necessary), the white light is detected when the reflected light reaches the photo sensors 51, 53. From each of the photo sensors, it is possible to confirm that a normal operation is carried out.

On the other hand, when the phosphor 9 is detached or damaged, the laser light is not wavelength-converted into the white light and reaches the escape hole 41 while maintaining strong directivity, thereby being detected as the laser light by the third photo sensor 49 provided in the optical path of the laser light. Since this laser light is not a scattered light, the laser light does not reach the surface of the reflector 43 other than the escape hole 41. Accordingly, there is no case that the laser light is reflected in the reflector 43 and the lens 55, and thus, reaches the fourth photo sensor 51 and the fifth photo sensor 53. That is, the case where the laser light is detected in the third photo sensor 49 or the case where light is not detected in the fourth and fifth photo sensor 51, 53 is a sign indicating that abnormality occurs in the phosphor 9. Accordingly, it is desirable to prevent the leakage of the laser light by quickly turning off the lamp.

Figure 5:
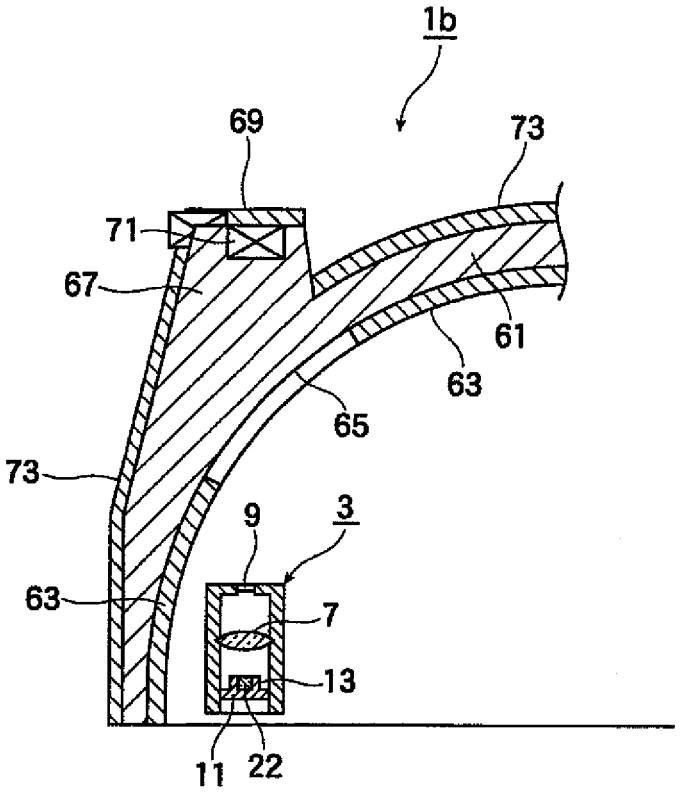
FIG. 5 is a longitudinal sectional view of a vehicle lamp according to a third embodiment of the present invention.
Figure 6:
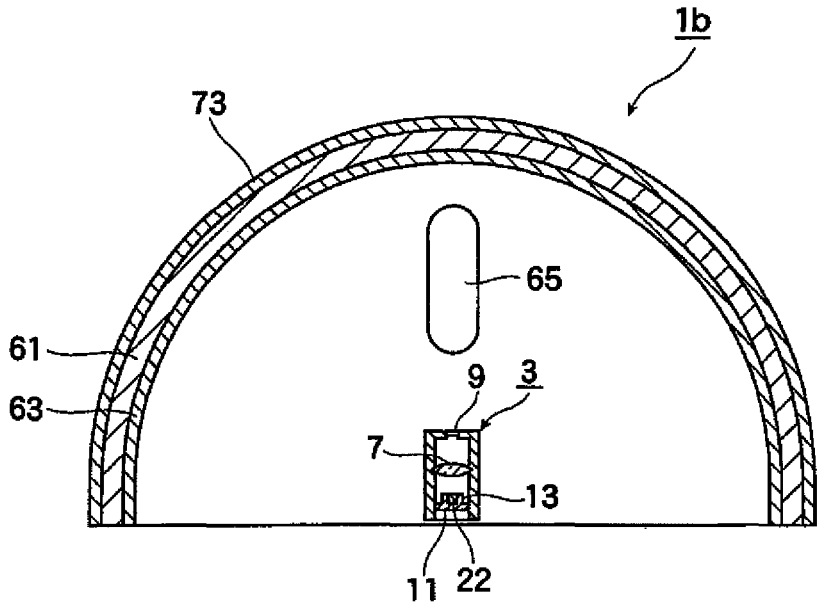
FIG. 6 is a side view of FIG. 5.

A light emitting device 3 of a lamp unit 1*b* of a third embodiment shown in FIGS. 5 and 6 has substantially the same configuration as the light emitting device 3 of the first embodiment. Therefore, the same or similar parts are denoted by the same or similar reference numerals and a duplicated description thereof will be omitted.

In the third embodiment, a reflector 61 is molded of a transparent resin and a deposition layer 63 made of a metal or the like and configured to reflect light is formed on an inner surface of the reflector 61 other than the portion directly above the light emitting device 3. As an available transparent resin, an acrylic resin, polycarbonate resin and silicone resin can be used. Typically, the semiconductor laser element 22 has an elliptical shape and the laser light generated in the semiconductor laser element 22 also forms an elliptical light flux. In the abnormal situation where the phosphor 9 is not present, the laser light reaches the reflector 61 while maintain the elliptical shape. In order to allow the elliptical laser light not to be reflected but to be absorbed in the reflector, it is desirable that an elliptical non-deposition portion 65 is formed on the surface of the reflector 61 directly above the light emitting device 3.

A protruding portion 67 is provided on an upper portion side of a transparent resin base body as the reflector 61 and a concave portion is formed in the protruding portion 67. A sixth photo sensor 71 fixed on a substrate 69 is embedded into the concave portion. In the present embodiment, the reflector 61 is made of a transparent resin and the photo sensor can be fixed to the reflector simply by embedding the photo sensor therein without using a separate holding member. Further, a light-shielding layer 73 is coated and formed on the surface of the upper surface of the reflector 61 other than the protruding portion 67. The light-shielding layer 73 may be formed by a coating of a black paint or the like, Also in the third embodiment, in the normal situation, the phosphor 9 is normally operated to convert the wavelength of at least a portion of the laser light. In this way, the strong directivity of the high-energy laser light is weakened, and thus, a low-energy white light is generated. The white light reaches the lower surface of the reflector 61 including the non-deposition portion 65. The white light reaching the non-deposition portion 65 is directly incident on the transparent resin base body as the reflector 61 and travels along the inside of the transparent resin base body. In this way, the white light reaches the sixth photo sensor 71 and is detected therein. The white light reaching the deposition layer 63 other than the non-deposition portion 65 is reflected in the deposition layer 63, thereby irradiating the front of the vehicle.

When the phosphor 9 is detached or damaged, the laser light is not wavelength-converted into the white light and reaches the non-deposition portion 65 while maintaining strong directivity. Then, the laser light is incident on the transparent resin base body, thereby being detected as the laser light by the sixth photo sensor 71. Since this laser light is not a scattered light, the laser light does not reach the deposition layer 63 on the surface of the reflector 61 other than the non-deposition portion 65. Accordingly, there is no case that the laser light is reflected in the reflector 61, and thus, is irradiated to the front of the vehicle. In this way, the transparent resin base body serves as the light confinement portion. The case where the laser light is detected in the sixth photo sensor 71 is a sign indicating that abnormality occurs in the phosphor 9. Accordingly, it is desirable to prevent the leakage of the laser light by quickly turning off the lamp.

Further, many parts are provided in the lamp unit 1*b*. There is a possibility that laser light incident on the reflector 61 is reflected by many parts in the lamp unit 1*b* and is irradiated to the outside of the lamp unit 1*b*. In the present embodiment, the light-shielding layer 73 is coated and formed on the upper surface of the transparent resin base body opposite to the deposition layer 63. At least a portion of the laser light reaching the light-shielding layer 73 is wavelength-converted or absorbed in the light-shielding layer 73, so that the leakage of the laser light can be suppressed to the minimum.

Figure 7:
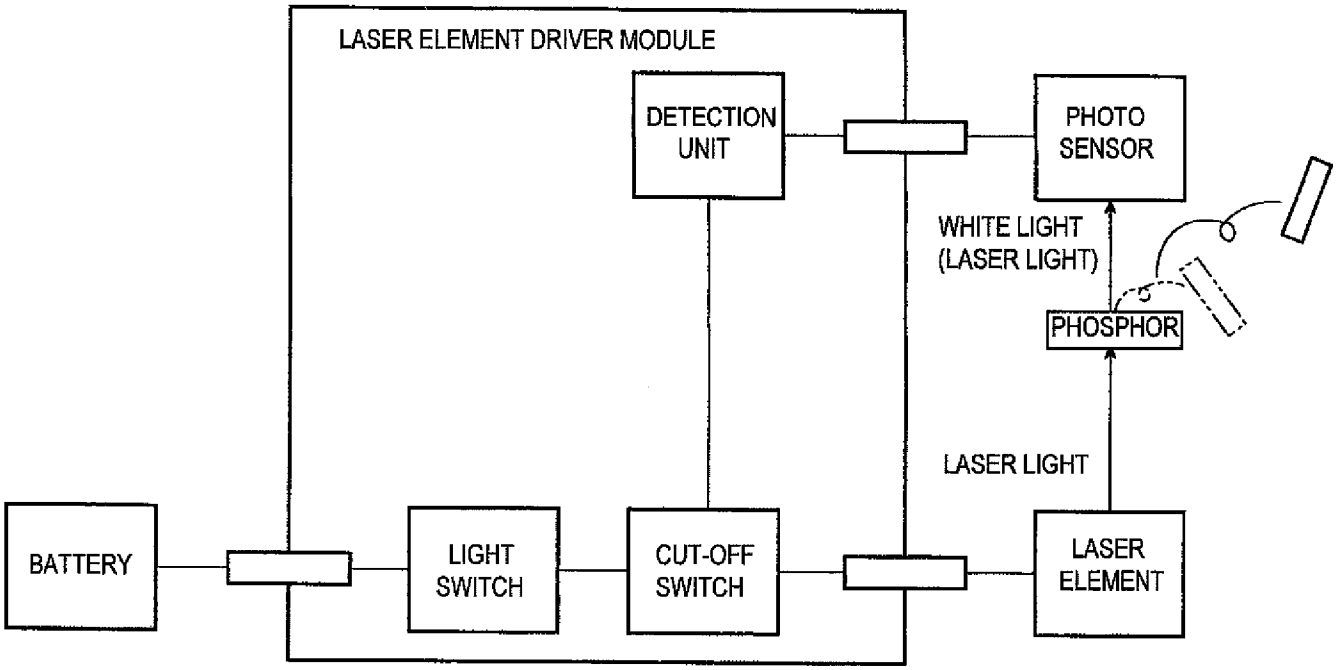
FIG. 7 is a block diagram illustrating the function of the vehicle lamp of the present invention.

FIG. 7 is a block diagram illustrating the function of a photo sensor included in the vehicle lamp of the present invention. The block diagram is composes of a laser element driver module having a light switch, a cut-off switch and a detection unit, a battery on the upstream side of the module, a laser element on the downstream side of the module, a phosphor, and a photo sensor. The light switch is installed in a driver's seat and is adapted to turn on or off the laser element by an operation of a driver. The cut-off switch is connected between the light switch and the laser element and is connected to the photo sensor via the detection unit. Although not shown, a light emitting diode (LED) may be connected in parallel with the laser element.

Since it is not required to turn on the lamp during a normal daytime driving, the light switch is turned off to cut the connection between the battery and the laser element, and thus, power is not supplied to the laser element. It is desirable that the cut-off switch is always turned on.

During a night driving, the light switch is operated to electrically connect the battery and the laser element via the cut-off switch. As power is supplied to the laser element, laser light such as blue laser light is generated from the laser element. The laser light travels toward the phosphor and is wavelength-converted in the phosphor. In this way, the laser light is converted into a low-energy white light (scattered light) having weak directivity and is reflected in the reflector (not shown), thereby irradiating the front of the vehicle. A portion of the white light is incident on the photo sensor, so that the white light is detected. Thereby, it is confirmed that the phosphor is normally operated.

However, when the phosphor is detached or damaged, and thus, the laser light is not wavelength-converted, the laser light is incident on the photo sensor or a white light, which should be incident in a normal situation, is not incident on the photo sensor. Accordingly, there is a possibility that the high-energy laser light is irradiated to the front of the vehicle. In this case, a signal from the photo sensor is detected in the detection unit and the cut-off switch is immediately turned off, thereby suppressing the leakage of the laser light to the minimum. Further, in order to protect a pedestrian in a low-speed driving, the light source may be switched from the laser element to the light emitting diode by using a change-over switch in the low-speed driving.

What is claimed is:

1. A vehicle lamp comprising:

a semiconductor laser element configured to emit laser light;

a condenser lens configured to condense the laser light;

a phosphor configured to form white light by converting wavelength of at least a portion of the laser light condensed; and a reflector configured to reflect the white light, wherein a light transmitting portion is formed in a portion, at which an extension path obtaining by extending an optical path of the laser light before contacting the phosphor is intersected with the reflector, of the reflector, wherein a light confinement part is formed above the light transmitting portion, wherein the reflector comprises:

a reflecting surface, and an opposite surface disposed on an opposite side of the reflecting surface, wherein the light transmitting portion is formed as an escape hole, wherein the light confinement part is formed above the escape hole, wherein the light confinement part is a closed space formed by a wall surface and the opposite surface, wherein a photo sensor is provided in a region other than a point where the extended optical path of the laser light and the wall surface intersect, wherein at least a portion of the wall surface where the extended optical path of the laser light and the wall surface intersect forms a light scattering surface that is configured to generate a scattered light, and wherein the photo sensor is configured to detect the scattered light.

2. The vehicle lamp according to claim 1, wherein the vehicle lamp further comprises a light-shielding metal configured to reduce a leakage amount of light, the light-shielding metal provided on the extension path of the optical path of the laser light in the closed space.

3. A vehicle lamp comprising:

a semiconductor laser element configured to emit laser light;

a condenser lens configured to condense the laser light;

a phosphor configured to form white light by converting wavelength of at least a portion of the laser light condensed; and a reflector configured to reflect the white light, wherein a light transmitting portion is formed in a portion, at which an extension path obtaining by extending an optical path of the laser light before contacting the phosphor is intersected with the reflector, of the reflector, wherein a light confinement part is formed above the light transmitting portion, wherein the reflector has a transparent resin base body, and a reflective surface of the reflector is formed by a deposition layer which is coated and formed on a part of an inner surface of the reflector, and wherein a surface, which is surrounded by the deposition layer and on which the deposition layer is not formed, serves as the light transmitting portion, and the transparent resin base body serves as the light confinement part.

4. The vehicle lamp according to claim 3, further comprising:

a photo sensor provided on the extension path of the optical path of the laser light in the transparent resin base body.

5. The vehicle lamp according to claim 3, wherein a light-shielding layer is coated and formed on a surface opposite to the surface of the transparent resin base body where the deposition layer is formed.

6. A vehicle lamp comprising:

a semiconductor laser element configured to emit laser light;

a condenser lens configured to condense the laser light;

a phosphor configured to form white light by converting wavelength of at least a portion of the laser light condensed; and a reflector configured to reflect the white light, wherein a light transmitting portion is formed in a portion, at which an extension path obtaining by extending an optical path of the laser light before contacting the phosphor is intersected with the reflector, of the reflector, wherein a light confinement part is formed above the light transmitting portion, wherein the vehicle lamp further comprises:

a shade provided between the phosphor and the light transmitting portion, and wherein the shade has a pin hole formed in such a way that a straight line connecting an expected maximum movement position of the condenser lens and an outer edge of the light transmitting portion passes through the inside of the pin hole.

* * * * *